US005891206A

United States Patent [19]

Ellingson

[11] Patent Number: 5,891,206

[45] Date of Patent: Apr. 6, 1999

[54] SINTERED ABRASIVE TOOLS

[75] Inventor: Thomas Ellingson, Worcester, Mass.

[73] Assignee: Norton Company, Worcester, Mass.

[21] Appl. No.: 854,014

[22] Filed: May 8, 1997

[51] Int. Cl.[6] ..... B24B 11/00

[52] U.S. Cl. ..... 51/309; 451/12

[58] Field of Search ..... 51/307, 309; 451/42

[56] References Cited

U.S. PATENT DOCUMENTS

| | | | |
|---|---|---|---|
| 3,779,727 | 12/1973 | Siqui et al. | 51/298 |
| 3,795,497 | 3/1974 | Weiss | 51/297 |
| 3,925,035 | 12/1975 | Keat | 51/309 |
| 4,042,347 | 8/1977 | Sioui | 51/298 |
| 4,184,854 | 1/1980 | Sioui et al. | 51/298 |
| 4,378,233 | 3/1983 | Carver | 51/298 |
| 4,523,930 | 6/1985 | Williston | 51/307 |
| 5,385,591 | 1/1995 | Ramanath et al. | 51/309 |
| 5,471,970 | 12/1995 | Sakarcan | 125/15 |

FOREIGN PATENT DOCUMENTS

| | | |
|---|---|---|
| 2-116475 | 5/1990 | Japan . |
| 722750 | 3/1980 | Russian Federation . |

*Primary Examiner*—Deborah Jones
*Attorney, Agent, or Firm*—Mary E. Porter

[57] ABSTRACT

Light weight metal bonded abrasive tools consisting of an annular rim of metal bonded superabrasive joined to a central core or hub made from a dissimilar metal, such as aluminum powder, are manufactured in a single sintering step that yields a near net shape abrasive tool. The abrasive tools are useful for the grinding of optical components made of plastic or glass.

13 Claims, No Drawings

SINTERED ABRASIVE TOOLS

The invention relates to light weight metal bonded abrasive tools consisting of an annular rim of metal bonded superabrasive joined to a central core of a dissimilar metal. The metal bond, the central core and the joint may be manufactured to near net shape in a single sintering process. The abrasive tools are useful for grinding the edges of plastic lenses used to make eyeglasses and other optical components.

BACKGROUND OF THE INVENTION

In the manufacture of optical components and other precision components having precise tolerances for the component's geometry and surface qualities, the creation of thermal and material stresses must be minimized. The preferred abrasive tools are light in weight so as to permit high speed grinding while reducing stress on the grinding machine; have consistent wheel geometry and form holding ability; exhibit freeness of cut so as to minimize power draw and the accompanying stresses; minimize wheel loading; and are simple to dress, mount and otherwise handle during such operations.

High speed, light weight abrasive grinding wheels have been constructed from a variety of materials and typically comprise two parts: a hub and an abrasive rim. Solid or aluminum filled bronze or steel or solid or metal filled resin materials have been used in the core or hub component. In the abrasive rim component of the wheels, diamond or cubic boron nitride (CBN) abrasive grains are bonded in a matrix of metal or resin. Due to differences in the chemistries of the materials used in the core and the rim, respectively, and in their density and strength characteristics, together with differences in the functional purposes of the core and the abrasive rim components, the core and the rim components typically are constructed in separate operations. The abrasive rim component usually is constructed as a preformed module. Then the preformed module is joined to the rim of the core of hub with an adhesive cement, or by brazing, welding or similar techniques. Conventional processes are described in U.S. Pat. No. 4,378,233 and U.S. Pat. No. 3,925,035.

Manufacture of such tools is complex and costly. By pressing the lightweight core and the abrasive rim simultaneously, production costs are reduced. An example alternative process, which would be more labor intensive, consists of additional machining steps to fit the lightweight core and abrasive rim as well as mating the two parts with an adhesive or shrink fitting. Consistent wheel geometry and form holding ability are difficult to achieve in these processes for making light weight abrasive grinding wheels. Several improvements have been suggested, but none have addressed the manufacture of metal bonded abrasives on a light weight metal core in a satisfactory manner.

To attain the weight reduction that is critical to operation of these tools, cores have been made of bronze, molded to the final desired shape, and then hollowed out and filled with aluminum to lighten their weight. Different materials have been used in cores to attain operational considerations other than weight reduction. In U.S. Pat. No. 4,184,854 the wheels were designed to be mounted on a magnetic chuck, with optional magnetic holding parts, during the grinding operations. In making such wheels, the core is made of a resin filled with a magnetic metal powder (e.g., 43–72 wt. % iron) and aluminum powder, and the abrasive rim is a resin or a metal bond containing diamond abrasive grain. Zinc or tin may be substituted for the resin in the core to give an all metal bond. The tool is preferably constructed using the same resin in the core and rim so both components can be molded and cured simultaneously at a temperature of about 200° to 300° C. under sufficient pressure to achieve essentially theoretical density.

In GB-B-1,364,178 wheels are made by molding an aluminum powder core section and simultaneously sintering and bonding it to a polyimide resin diamond rim section at 350° to 550° C. by hot pressing.

In U.S. Pat. No. 4,042,347, a resin (polyimide) and metal powder mixture are co-sintered at a temperature of about 350° C. to bond superabrasive grain in the rim component of a grinding wheel. The rim is bonded to a core of aluminum filled phenolic resin by an epoxy cement to make the finished wheel. The use of a core having the same co-sintered resin and metal powder mixture as the rim and substituting silicon carbide for superabrasive grain is suggested. This core would be joined to the rim by a cement.

In U.S. Pat. No. 5,471,970 saw blades for cutting concrete and other abrasive materials are made by molding metal powder bond components with abrasive grain around the perimeter of a preformed steel core and then sintering the molded tool at 760°–1093° C. (1400°–2000° F.) to achieve diffusion bonding of the abrasive rim to the steel core. In a second step, gullets are cut into the rim and, optionally, the perimeter of the core, to relieve stresses during cutting operations. Neither tool weight reduction nor continuous rim geometry are critical variables in making these saw blades.

Abrasive tools designed for chamfering operations on automobile windows and other glass substrates and having a metal bonded superabrasive grain rim on a resin core are described in JP-2-116475. The light weight of the resin core relative to conventional steel cores is taught to yield a 20–30% improvement in grinding time. The resin core is filled with powder of conductive metal and, optionally graphite powder, glass fiber or carbon fiber to allow electrical discharge machining of the wheels and to achieve core strength similar to that of steel cores. Attachment of the core to the rim is not described. An eccentric shaped rim, sandwich structures and concave/convex areas at contact points between the rim and the core are suggested as means to avoid detachment of the rim during grinding.

It has been discovered that abrasive tools having a metal core and a metal bonded abrasive rim may be made by sintering metal powder core and rim mixtures and joining the rim to the core in a single sintering step. By molding both components together during sintering, a near net shape tool is released from the mold. Higher porosity volume without loss of mechanical strength may be attained with this co-sintering process. The combined porosity of the rim and the core resulting from sintering the metal powders yields a light weight, mechanically strong tool capable of precision grinding operations at high speed.

SUMMARY OF THE INVENTION

The invention is an abrasive tool consisting of an annular rim sintered to a central hub, wherein the annular rim comprises superabrasive grain in a metal matrix bond, the central hub comprises a sintered metal containing 60 to 100 wt. % of a metal powder selected from the group consisting of aluminum, titanium and magnesium, and their alloys, and combinations thereof, and the sintered metal of the central hub has a density less than 4.5 g/cc.

The abrasive tool and the central hub may be sintered in a single hot pressed process at a temperature of about 500° to 700° C. under a pressure of, e.g., about 15 MPa to 48 MPa.

The invention also provides a method for grinding optical components, comprising the steps:

a) providing an abrasive wheel consisting of an annular rim sintered to a central hub, wherein the annular rim comprises superabrasive grain in a metal matrix bond and the central hub comprises a sintered metal powder having a density less than 4.5 g/cc and is adapted for mounting on a spindle;

b) mounting the abrasive wheel on a spindle adapted for rotational movement;

c) rotating the abrasive wheel at a speed of at least 200 rpm;

d) bringing the rotating abrasive wheel into contact with a workpiece material selected from the group consisting of glass and plastic and combinations and laminations thereof; and e) grinding the workpiece with the abrasive wheel for a period of time effective to produce a contour in an edge of the optical component.

DESCRIPTION OF THE PREFERRED EMBODIMENTS

The abrasive tools of the invention are preferrably grinding wheels comprising a metal core for mounting the wheel on a grinding machine and supporting a metal bonded superabrasive rim at the periphery of the wheel.

The superabrasive may be selected from diamond, natural and synthetic, CBN, and combinations of these abrasives. For grinding and polishing of optical plastics and glass, a superabrasive grain size ranging from 2 to 300 microns is preferred. There are customarily three types of edge grinding operations, and, therefore, three types of grinding wheels, which will convert a circular lense blank into a lense with a polished, contoured edge. These operations are sequentially 1) roughing, 2) finishing and 3) polishing. For roughing wheels, a superabrasive grain size of about 125 to 300 micrometers (60 to 120 grit; Norton grit size) is generally preferred. For finishing wheels, a grain size of about 45 to 80 micrometers (200 to 400 grit), is generally preferred. For polishing wheels, grain size of 2 to 30 micrometers (500 grit or higher) is generally preferred.

As a volume percentage of the abrasive rim, the tools comprise 5 to 15% superabrasive grain, preferably 6 to 12.5%. Secondary abrasive grains may be used in conjunction with the superabrasive grain for supplemental grinding effects or for filler or spacer effects. As a volume percentage of the rim component, the secondary abrasive may be used at 0–15 vol. %, preferably 0.1 to 10 vol. %, most preferably 0.1 to 5 vol. %. Silicon carbide, cerium oxide, and alumina are three secondary abrasives or fillers which may be utilized.

Although any metal bond known in the art for bonding superabrasives in an abrasive tool may be employed herein, materials suitable for forming a diffusion bond or other physical or chemical bond at the interface of the rim and core components are preferred. In particular rim and core metal powders having similar melting points or rim and core metals suitable for forming an eutectic mixture are selected. Also preferred, particularly for grinding relative soft or gummy materials such as plastics, are metal powders tending to form a relatively porous bond structure to aid clearance of debris during grinding. At the temperatures preferred for sintering the wheel, a bronze bond forms such a porous structure in the rim component of the tool.

Other materials useful in the metal bond of the rim include, but are not limited to, copper and zinc alloys (brass), tin, copper, silver, nickel, cobalt, iron, and their alloys and mixtures thereof. These metals may be used with, optionally, titanium or titanium hydrite, or other active bond components capable of forming a carbide or nitride at the surface of the superabrasive grain under the selected sintering conditions and thereby strengthening the grain bond posts.

In the core, light weight metal powders (i.e., densities of about 1.8 to 4.5 g/cc), such as aluminum, mangnesium and titanium, and alloys thereof, and mixtures thereof, are preferred. Aluminum and aluminum alloys are especially preferred. Metals having melting temperatures between 570° and 650° C. are selected for the co-sintering process used in the invention. Low density filler materials may be added to further reduce the weight of the core. Porous and/or hollow ceramic or glass fillers, such as glass spheres and mullite spheres are preferred. Also useful are inorganic and nonmetallic fiber materials. When indicated by processing conditions, an effective amount of lubricant or other processing aids known in the metal bond and superabrasive arts may be added to the metal powder before pressing and sintering.

In a preferred embodiment of the abrasive rim, the metal powder comprises 60 to 90 wt. % of the metal bond of the rim, more preferably 70 to 90 wt. %. The filler comprises 0 to 28 vol. % (0 to 20 wt. % for hollow mullite spheres) of the metal bond of the rim, more preferably 0.1 to 15 vol. %. Lubricant, such as graphite, comprises 0 to 10 wt. % of the metal bond of the rim, more preferably 0.1 to 8 wt. %.

In a preferred embodiment, the core is made with 60 to 100 wt. % aluminum powder with, optionally, 0.01 to 5 wt. % copper powder and 0.01 to 20 volume % hollow fillers such as Z-Light glass spheres or mullite spheres, and the rim is made with copper and tin powders to yield a bronze bond with, optionally, phosphorous to form a eutectic mixture and graphite as a filler and lubricant. The metal powders of this composition may be sintered or densified together in the range of 570°–650° C. at 20 to 60 MPa.

In a typical wheel manufacturing process, the metal powder of the core is poured into a steel mold and cold pressed at 80 to 200 kN to form a green part having a size approximately 1.2 to 1.6 times the desired final thickness of the core. The green core part is placed in a graphite mold and a mixture of the abrasive grain and the metal bond powder blend is added to the cavity between the core and the outer rim of the graphite mold. A setting ring may be used to compact the abrasive and metal bond powders to the same thickness as the core preform. The graphite mold contents are then hot pressed at 570° to 650° C. under 32 to 48 MPa of pressure for 6 to 10 minutes. As is known in the art, the temperature may be ramped up (e.g., from 25° to 570° C. for 6 minutes; held at 570° C. for 9 minutes) or increased gradually prior to applying pressure to the mold contents.

Following hot pressing, the graphite mold is stripped from the part, the part is cooled and the part is finished by conventional techniques to yield an abrasive wheel having the desired dimensions and tolerances. For example, the part may be finished to size using vitrified grinding wheels on grinding machines or carbide cutters on a lathe. As a result of co-sintering the core and rim of the invention, less material removal is needed to put the part into its final shape. In prior art processes, machining of both the core and the rim was needed, as well as a cementing step, to finish the part. Thus, an added benefit of the invention is a reduction in finishing operation steps.

EXAMPLE 1

An 1A1 type wheel (O.D.=110 mm, I.D.=20 mm, thickness 20 mm, abrasive rim depth 3.2 mm (⅛ inch)) was manufactured in a graphite mold by simultaneously hot pressing and joining the rim and core components described below at 580° C. under 32 MPa for 9 minutes to form a near net shape wheel.

TABLE 1

| Abrasive Rim | Weight % of Rim | Volume % of Rim |
|---|---|---|
| Diamond 180 micron (100 grit*) Synthetic | 3.05 | 6.14 |
| Copper Powder[1] | 76.95 | 60.52 |
| Tin Powder[2] | 13.66 | 13.19 |
| Phosphorous[3] | 0.46 | 1.75 |
| Graphite[4] | 5.87 | 18.39 |
| **Core** | **Weight % of Core** | **Volume % of Core** |
| Aluminum Powder[5] | 98.5 | 99.50 |
| Copper Powder | 1.50 | 0.50 |

*According to U.S. Mesh grit size standards.
[1]supplied by Sintertech International Marketing Corp.
[2]supplied by Alcan Metal Powders, Inc
[3]supplied by New Jersey Zinc Company
[4]supplied by Ashby Graphite Mills
[5]supplied by Reynolds Aluminum Following sintering, the wheel contained a copper/aluminum bond at the interface between the rim and the core and was successfully operated in the edge grinding of plastic optical components at typical metal bonded tool rates of 25 m/s (4900 sfpm). Thus, during grinding operations, the joint between the rim and the core was characterized by a mechanical strength equivalent to that of a brazed joint of a conventional metal core/metal bonded superabrasive wheel. Relative to a commercial control wheel comprising a sintered bronze core, the experimental wheel's core weight was reduced 69%. The density of the core in the experimental wheel was calculated to be 2.77 g/cc. In speed testing, the wheel qualified for 52 m/s (10,185 sfpm) without wheel failure. Thus, the maximum speed prior to product failure would be even higher.

The performance of the wheel was found to exhibit the same results as the wheel with the sintered bronze core, although the bronze cored wheel was sintered at a higher temperature. This type of wheel, traditionally called a roughing wheel, was used to rough out the contours of the edges of eye glass lenses. Relative to the conventional wheels, the desirable performance characteristic exhibited by the wheel of the invention was a quiet cutting action with very little wheel loading, while maintaining a high material removal rate and good form holding characteristics.

EXAMPLE 2

An 1A1 type wheel (O.D.=110 mm, I.D.=20 mm, thickness 18 mm, abrasive rim depth 3.2 mm (⅛ inch)) was manufactured using the same materials as used in Example 1 in a graphite mold by simultaneously hot pressing and joining the rim and core components described below at 580° C. under 32 MPa for 9 minutes to form a near net shape wheel. Prior to hot pressing, the components were cold pressed at room temperature for 5 seconds under 210 Mpa of pressure.

TABLE 2

| Abrasive Rim | Weight % of Rim | Volume % of Rim |
|---|---|---|
| Diamond 46 micron (400 grit) natural | 4.85 | 11.00 |
| Copper Powder | 80.40 | 71.38 |
| Tin Powder | 14.27 | 15.55 |
| Phosphorous | 0.48 | 2.07 |
| **Core** | **Weight % of Core** | **Volume % of Core** |
| Aluminum Powder | 98.5 | 99.50 |
| Copper Powder | 1.5 | 0.50 |

Following sintering, the wheel contained a copper/aluminum bond at the interface between the rim and the core and was successfully operated in the edge grinding of plastic optical components at typical metal bonded tool rates of 25 m/s (4900 sfpm). Thus, in grinding operations, the joint between the rim and the core was characterized by mechanical strength equivalent to that of a brazed joint of a conventional metal core/metal bonded superabrasive wheel. Relative to a commercial control wheel comprising a sintered bronze core, the experimental wheel's core weight was reduced 69%. The density of the core in the experimental wheel was calculated to be 2.77 g/cc.

Relative to the conventional wheels, the desirable performance characteristic exhibited by the wheel of the invention was a quiet cutting action with very little wheel loading, while maintaining a high material removal rate and good form holding characteristics.

EXAMPLE 3

An 1A1 type wheel (O.D.=110 mm, I.D.=20 mm, thickness 18 mm, abrasive rim depth 3.2 mm (⅛ inch)) is manufactured as in Example 1 in a graphite mold by simultaneously hot pressing and joining the rim and core components described below at 580° C. under 32 MPa for 9 minutes to form a near net shape wheel. Bubble mullite (Z-Light™, W-1000 grade spheres) is added to the core mixture prior to molding to further reduce the density. Prior to hot pressing, the components are cold pressed at room temperature for 5 seconds under 210 MPa of pressure.

TABLE 3

| Abrasive Rim | Weight % of Rim | Volume % of Rim |
|---|---|---|
| Diamond 46 micron (400 grit) natural | 4.85 | 11.00 |
| Copper Powder | 80.40 | 71.38 |
| Tin Powder | 14.27 | 15.55 |
| Phosphorous | 0.48 | 2.07 |
| **Core** | **Weight % of Core** | **Volume % of Core** |
| Aluminum Powder | 78.5 | 71.6 |
| Copper Powder | 1.5 | 0.4 |
| Bubbled Mullite | 20.0 | 28.0 |

Following sintering, the wheel contained a copper/aluminum bond at the interface between the rim and the core and was successfully operated in the edge grinding of plastic optical components at typical metal bonded tool rates of 25 m/s (4900 sfpm). Thus, in grinding operations, the joint between the rim and the core was characterized by mechanical strength equivalent to that of a brazed joint of a conventional metal core/metal bonded superabrasive wheel. Relative to a commercial control wheel comprising a sintered bronze core, the experimental wheel's core weight was reduced 80%. The density of the core in the experimental wheel was calculated to be 1.83 g/cc bulk density of Z-light spheres is 0.77 g/cc (wall density is 2.45 g/cc)).

Relative to the conventional wheels, the desirable performance characteristics the wheels of the invention exhibit are a quiet cutting action with very little wheel loading, while maintaining a high material removal rate and good form holding characteristics.

I claim:

1. An abrasive tool adapted for mounting on a grinding machine consisting of an annular rim sintered to a central hub, wherein the annular rim comprises superabrasive grain in a metal matrix bond, the central hub comprises sintered metal containing 60 to 100 wt. % of a metal powder selected from the group consisting of aluminum, titanium and magnesium, and their alloys, and combinations thereof, and the sintered metal of the central hub has a density less than 4.5 g/cc and wherein the annular rim and the central hub are sintered in a single sintering process.

2. The abrasive tool of claim 1, wherein the sintering process is carried out at 500° to 700° C. for 5 to 10 minutes.

3. The abrasive tool of claim 1, wherein the central hub further comprises 0.01 to 28 volume % of filler and 0.01 to 5 volume % of at least one metal selected from the group consisting of copper, tin, nickel, titanium, zinc, cobalt, silver and iron sintered with the metal powder.

4. The abrasive tool of claim 3, wherein the filler is selected from the group consisting of hollow glass spheres, hollow ceramic spheres, inorganic fiber, and nonmetallic fiber, and combinations thereof.

5. The abrasive tool of claim 1, wherein the metal matrix bond comprises at least one metal selected from the group consisting of copper, tin, cobalt, iron, titanium, and silver, and alloys thereof, and combinations thereof.

6. The abrasive tool of claim 5, wherein the metal matrix bond further comprises at least one component selected from the group consisting of phosphorous, graphite, titanium, and titanium hydrite.

7. The abrasive tool of claim 1, wherein the annular rim comprises 2 to 20 wt. % diamond, 80 to 98 wt. % bronze, 0.01 to 5 wt % phosphorous and 0.01 to 10 wt % graphite.

8. The abrasive tool of claim 7, wherein the central hub comprises aluminum.

9. The abrasive tool of claim 7, wherein the central hub comprises 60 to 99 wt % aluminum, 0.01 to 20 wt % hollow mullite spheres and 0.01 to 5 wt % copper.

10. A method for grinding optical components, comprising the steps:

a) providing an abrasive tool according to claim 1;

b) mounting the abrasive tool on a spindle adapted for rotational movement;

c) rotating the abrasive tool at a speed of at least 200 rpm;

d) bringing the rotating abrasive tool into contact with an optical component comprising a material selected from the group consisting of glass and plastic materials, and combinations thereof, and laminations thereof; and e) grinding the optical component with the abrasive tool for a period of time effective to produce a contour in an edge of the optical component.

11. The method of claim 10, wherein the optical component comprises polycarbonate plastic, the sintered metal powder comprises 90 to 98 wt % aluminum, 0.2 to 2 wt % copper and 1.8 to 8 wt % hollow mullite spheres, and the abrasive wheel is operated at a speed of 1 to 58 m/s (11,500 sfpm).

12. The method of claim 10, wherein the abrasive tool is an 1A1 type wheel.

13. The method of claim 10, wherein the annular rim comprises 5 to 15 wt. % diamond and 70 to 90 wt. % bronze.

* * * * *